US007635945B2

(12) United States Patent
Yang et al.

(10) Patent No.: US 7,635,945 B2
(45) **Date of Patent: *Dec. 22, 2009**

(54) FIELD EMISSION DEVICE HAVING A HOLLOW SHAPED SHIELDING STRUCTURE

(75) Inventors: Yuan-Chao Yang, Beijing (CN); Jie Tang, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/565,528

(22) Filed: Nov. 30, 2006

(65) Prior Publication Data

US 2008/0018227 A1 Jan. 24, 2008

(30) Foreign Application Priority Data

Jul. 21, 2006 (TW) ..... 95126673 A
Jul. 26, 2006 (CN) ..... 2006 1 0061804

(51) Int. Cl.
*H01J 1/62* (2006.01)
*H01J 63/04* (2006.01)

(52) U.S. Cl. ..... 313/497; 313/495; 313/496; 313/310; 313/311

(58) Field of Classification Search ..... 313/495–497, 313/306, 309–310, 346, 351, 355, 293–304
See application file for complete search history.

(56) References Cited

U.S. PATENT DOCUMENTS 6,250,984 B1 * 6/2001 Jin et al. ..... 445/51
6,522,055 B2 * 2/2003 Uemura et al. ..... 313/310
6,534,923 B2 * 3/2003 Espinosa ..... 315/111.81
6,692,327 B1 * 2/2004 Deguchi et al. ..... 445/49
6,801,352 B2 * 10/2004 Okura et al. ..... 359/253
7,104,859 B2 * 9/2006 Tsukamoto et al. ..... 445/23
7,220,159 B2 * 5/2007 Hsiao et al. ..... 445/24
2005/0280348 A1 * 12/2005 Chan et al. ..... 313/495
2006/0049737 A1 * 3/2006 Hsiao et al. ..... 313/311
2006/0132048 A1 * 6/2006 Popovich ..... 315/160
2006/0239891 A1 * 10/2006 Niu et al. ..... 423/445 R
2007/0046166 A1 * 3/2007 Okada et al. ..... 313/309
2007/0057621 A1 * 3/2007 Cho et al. ..... 313/496
2007/0063630 A1 * 3/2007 Guo et al. ..... 313/311
2007/0132363 A1 * 6/2007 Lin et al. ..... 313/496
2007/0145878 A1 * 6/2007 Liu et al. ..... 313/336

* cited by examiner

*Primary Examiner*—Sikha Roy
*Assistant Examiner*—Jose M Diaz
(74) *Attorney, Agent, or Firm*—D. Austin Bonderer

(57) ABSTRACT

A field emission device (10) includes a sealed container (11) with a light-permeable portion (12). A phosphor layer (13) is formed on the light-permeable portion. A light-permeable anode (14) is formed on the light-permeable portion. At least one cathode is positioned opposite to the light-permeable anode. A shielding barrel (16) is electrically connected to the at least one cathode and disposed in the container. The shielding barrel has opposite open ends respectively facing towards the light-permeable anode and the cathode (18, 19). The shielding barrel has an inner surface, and a slurry layer (17) containing conductive nano material is formed on the inner surface of the shielding barrel.

17 Claims, 2 Drawing Sheets

FIELD EMISSION DEVICE HAVING A HOLLOW SHAPED SHIELDING STRUCTURE

CROSS-REFERENCE TO RELATED APPLICATIONS

This application is related to commonly-assigned copending application Ser. No. 11/565,533, filed on Nov. 30, 2006, entitled "FIELD EMISSION DEVICE" Disclosures of the above-identified application are incorporated herein by reference.

BACKGROUND OF THE INVENTION

1. Field of the Invention

The present invention relates to field emission devices, and more particularly to a field emission device employing nano material.

2. Description of Related Art

Field emission devices are based on emission of electrons in a vacuum. Electrons are emitted from micron-sized tips in a strong electric field, the electrons are then accelerated and collide with a fluorescent material. The fluorescent material then emits visible light. Field emission devices are thin, light weight, and provide high levels of brightness.

Conventionally, a material of the tips is selected from the group consisting of molybdenum (Mo) and silicon (Si). With the development of nano-technology, carbon nanotubes (CNT) can also used for the tips of the field emission devices. However, typical working voltage of such field emission devices is about 10,000 volts, which creates enough electrostatic force to make break CNTs. As a result, performance of field emission devices may be unstable.

What is needed, therefore, is a field emission device capable of stable operation.

SUMMARY OF THE INVENTION

A field emission device includes a sealed container with a light-permeable portion. A phosphor layer is formed on the light-permeable portion. A light-permeable anode is formed on the light-permeable portion. At least one cathode is opposite to the light-permeable anode. A shielding barrel is electrically connected to the at least one cathode and disposed in the container. The shielding barrel has opposite open ends facing towards the light-permeable anode and the cathode respectively. The shielding barrel has an inner surface, and a slurry layer containing conductive nano-material is formed on the inner surface of the shielding barrel.

BRIEF DESCRIPTION OF THE DRAWINGS

Many aspects of the present field emission device can be better understood with reference to the following drawings. The components in the drawings are not necessarily drawn to scale, the emphasis instead being placed upon clearly illustrating the principles of the present field emission device. Moreover, in the drawings, like reference numerals designate corresponding parts throughout the several views.

DETAILED DESCRIPTION OF THE INVENTION

Reference will now be made to the drawings to describe in detail the preferred embodiment of the field emission device.

Figure 1:
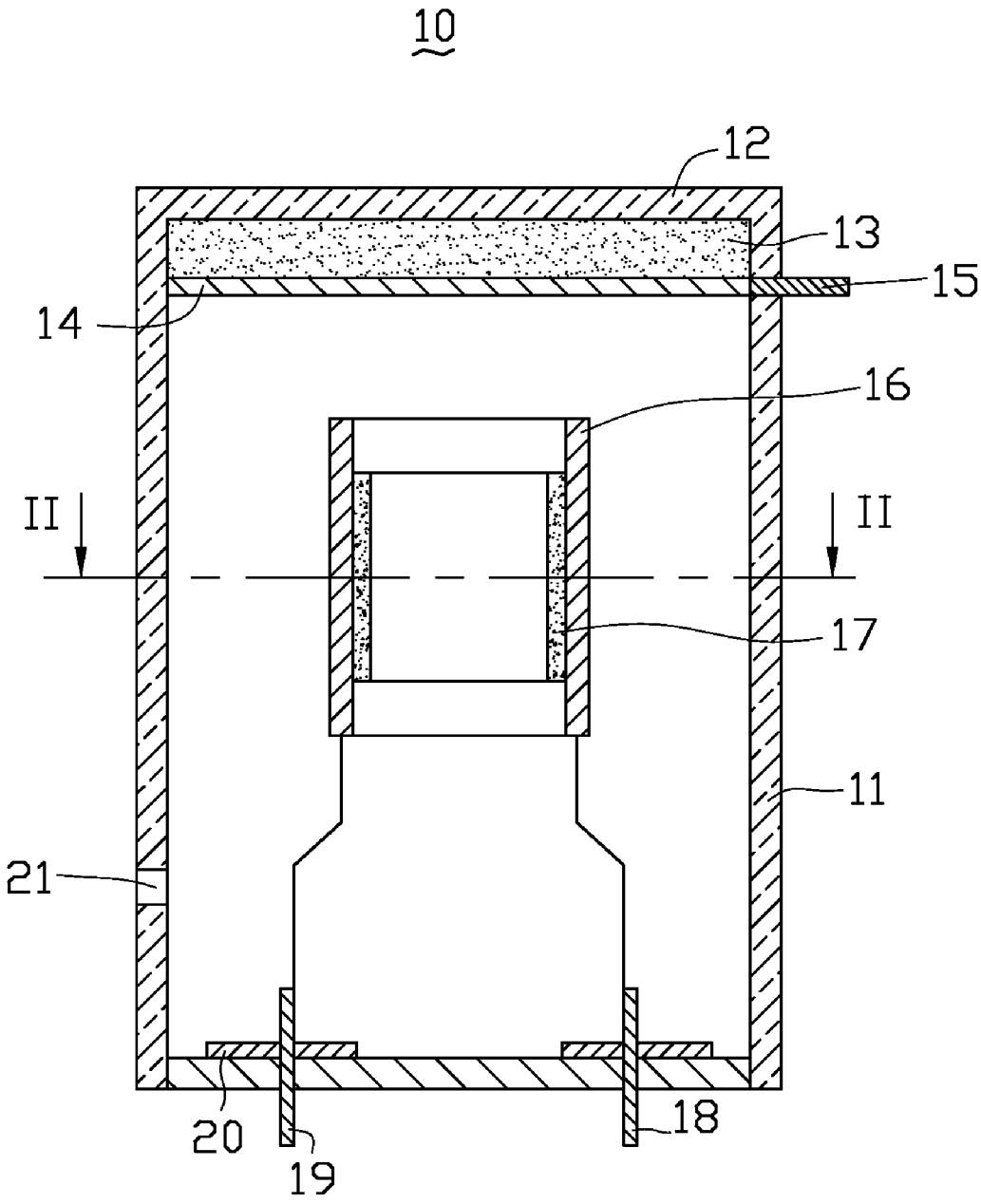
FIG. 1 is a schematic, cross-sectional view of a filed emission device in accordance with a preferred embodiment.
Figure 2:
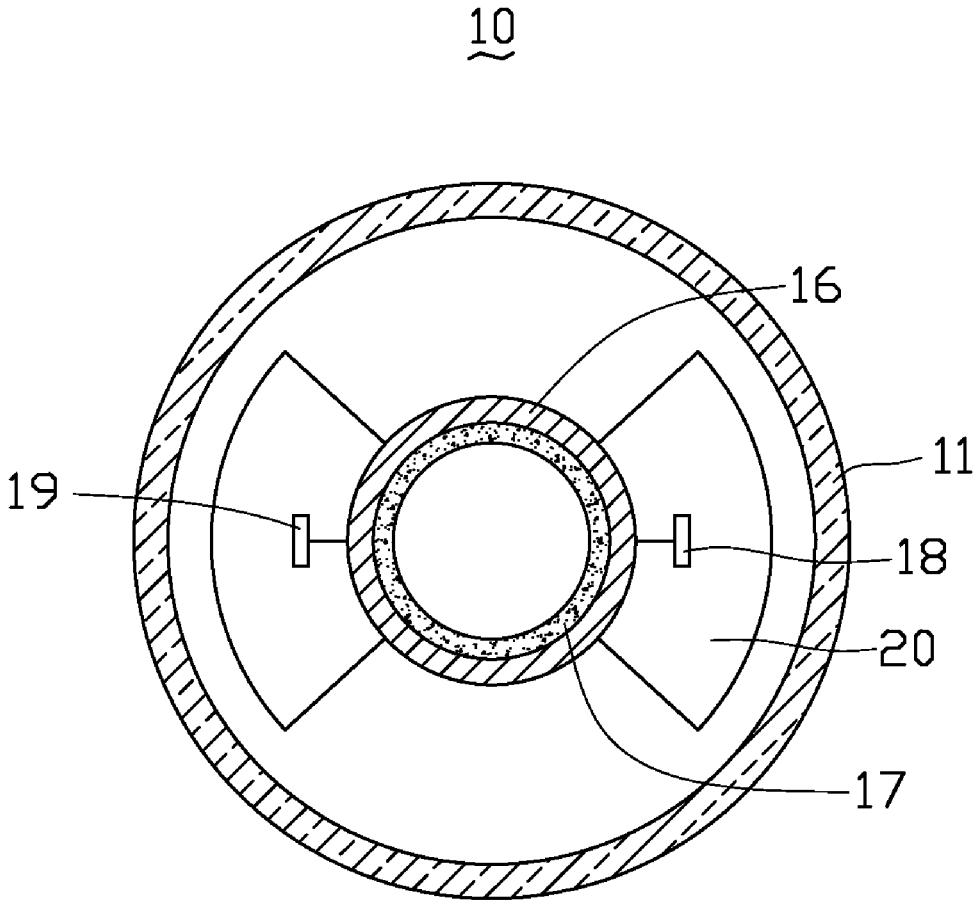
FIG. 2 is a schematic, cross-sectional view of the filed emission device of FIG. 1 taken along the line II-II thereof.

Referring to FIGS. 1 and 2, a field emission device 10 includes a light-permeable portion 12, and a sealed container 11. The sealed container 11 encloses a light-permeable anode 14 and a shielding barrel 16. A phosphor layer 13 is deposited on the light-permeable portion 12. The phosphor layer 13 contains fluorescent material that can emit white or colored light when being bombarded with electrons. The light-permeable anode 14 is applied onto the phosphor layer 13. The shielding barrel 16 is arranged in the middle of the sealed container 11. A solidified nano slurry layer 17 is formed on an inner surface of the shielding barrel 16. The shielding barrel 16 is connected with at least one cathode. In the illustrated embodiment, the shielding barrel is connected with two cathodes 18, 19. The light-permeable anode 14 and the terminal are electrically connected with an anode wire 15, which leads (i.e., runs) from the inside to outside of the sealed container 11. The anode wire 15 as well as the cathodes 18, 19 are electrically connected with respective terminals for enabling application of an electric field through the shielding barrel 16 and the light-permeable anode 14.

The sealed container 11 is a hollow member that defines an inner space, the inner space containing a vacuum. The main portion of the sealed container 11 in cross-section can be, for example, a circle, a quadrangle, a triangle, or a polygon. In the illustrated embodiment, the main portion of the sealed container is a cylinder. The light-permeable portion 12 may be a planar surface, a spherical surface, or an aspherical surface, which can be selected according to application. The sealed container 11 should be light-permeable, and should preferably be transparent. The sealed container 11 according to the embodiment is made of a nonmetal material, for example, quartz or glass. Such materials as quartz or glass are beneficial in that they are electrically insulative.

The light-permeable anode 14 is a metal film with good electrical conductivity. In the preferred embodiment, the anode 14 is an aluminum film. In the illustrated embodiment, the shielding barrel 16 is a cylinder with a central axis oriented perpendicularly to the light-permeable portion 12. It can be understood that other shapes of the shielding barrel 16 can be selected according to the shape of the sealed container 11.

The solidified nano slurry layer 17 contains a conductive nano material. The conductive nano materials are selected from the group consisting of carbon nanotubes, carbon nanosticks, carbon nano-yarns, Buckminster-fullerenes (C60), carbon nano-particles. The conductive nano material is also can be selected from the group consisting of nanotubes, nanosticks, nano-yarns, and nano-particles of conductive metal and semiconductor material. In the preferred embodiment, the conductive nano material consists of carbon nanotubes. Firstly, the nano slurry is spread on the inner surface of the shielding barrel 16 and solidified. The slurry is then scrubbed with rubber to expose ends of the carbon nano tubes, thus enhancing the conductivity of the shielding barrel 16. Distance between edge (e.g., top end) of the nano slurry layer 17 and edge (e.g., top end) of the shielding barrel 16 determines shielding effect of the shielding barrel 16. The distance is bigger; the effect is more apparently.

Preferably, in order to maintain the vacuum of the inner space of the sealed container 11, a getter 20 may be arranged therein to absorb residual gas inside the sealed container 11. More preferably, the getter 20 can be arranged on an inner surface of the sealed container 11 around the cathodes 18, 19. The getter 20 may be evaporable getter introduced by high frequency heating. The getter 20 can also be non-evaporable getter. It must be ensured that the getter 20 does not form on the light-permeable anode 14, in order to avoid short-circuiting between the light-permeable anode 14 and the cathodes 18, 19.

The sealed container 11 further includes an air vent 21. The air vent 21 connects a vacuum pump to the sealed container 11 thus creating a vacuum before packaging the sealed container.

In operation, when putting a voltage over the cathodes 18, 19 and the light-permeable anode 14, electrons will emanate from two openings of the shielding barrel 16. The electrons move towards and transmit through the light-permeable anode 14. When the electrons hit the phosphor layer 13 visible lights will be emitted. One part of the light will transmit through the light-permeable portion 12, and the other part of the light will be reflected by the light-permeable anode 14, and spread out of the light-permeable portion 12. A plurality of such tubes 10 can be arranged together to use for lighting and displaying. Because of the shielding effect of the shielding barrel, the field emission device can operate with a higher level of stability at high voltages.

While the present invention has been described as having preferred or exemplary embodiments, the embodiments can be further modified within the spirit and scope of this disclosure. This application is therefore intended to include any variations, uses, or adaptations of the embodiments using the general principles of the invention as claimed. Further, this application is intended to include such departures from the present disclosure as come within known or customary practice in the art to which the invention pertains and which fall within the limits of the appended claims or equivalents thereof.

What is claimed is:

1. A field emission device, comprising:

a sealed container with a light-permeable portion;

a phosphor layer formed on the light-permeable portion;

a light-permeable anode formed on the light-permeable portion;

at least one cathode formed on the sealed container;

a hollow shaped shielding structure electrically connect to the at least one cathode and disposed in the container, the hollow shaped shielding structure having at least one opening defined therein, the opening facing towards at least part of the light-permeable anode, the hollow shaped shielding structure having an inner surface; and a slurry layer containing conductive nano material, the slurry layer located on at least a portion of the inner surface of the hollow shaped shielding structure, the slurry layer forms a hollow shape.

2. The field emission device as claimed in claim 1, wherein the sealed container is a vacuum container.

3. The field emission device as claimed in claim 1, wherein the sealed container is a hollow cylinder.

4. The field emission device as claimed in claim 1, wherein the sealed container is comprised of a material selected from the group consisting of quartz, glass and any combination thereof.

5. The field emission device as claimed in claim 1, wherein the light-permeable portion is flat, spherical, or aspherical in shape.

6. The field emission device as claimed in claim 1, wherein the light-permeable anode is an aluminum film.

7. The field emission device as claimed in claim 1, wherein the conductive nano material is selected from the group consisting of carbon nanotubes, carbon nano-sticks, carbon nano-yarns, Buckminster-fullerences, carbon nano-particles.

8. The field emission device as claimed in claim 1, wherein the conductive nano material is selected from the group consisting of nanotubes, nano-yarns, and nano-particles of conductive metal and semiconductor.

9. The field emission device as claimed in claim 1, further comprising a getter arranged around the cathode.

10. The field emission device as claimed in claim 1, wherein the phosphor layer is sandwiched between the light-permeable portion and the light-permeable-anode.

11. The field emission devices as claimed in claim 1, wherein central axis of the container is oriented perpendicularly to the light-permeable portion.

12. The field emission device as claimed in claim 1, wherein the shielding structure is a shielding barrel.

13. The field emission device as claimed in claim 12, wherein the shielding barrel is a cylinder.

14. The field emission device as claimed in claim 1, wherein the at least one open end of the shielding structure facing towards the light-permeable anode.

15. The field emission device as claimed in claim 1, wherein the shielding structure has opposite open ends facing towards the light permeable anode and the cathode respectively.

16. The field emission device as claimed in claim 1, wherein the shielding barrel has an inner surface including an intermediate portion and a peripheral exposed portion adjacent to the light-permeable anode, and the slurry layer is formed on the intermediate portion but not on the peripheral exposed portion.

17. The field emission device as claimed in claim 1, wherein a distance exists between top edges of the slurry layer and the shielding structure.

* * * * *